United States Patent [19]

Tabak et al.

[11] Patent Number: 4,483,760

[45] Date of Patent: Nov. 20, 1984

[54] PROCESS FOR DEWAXING MIDDLE DISTILLATES

[75] Inventors: Samuel A. Tabak, Wenonah; Robert E. Holland, Mullica Hill, both of N.J.

[73] Assignee: Mobil Oil Corporation, New York, N.Y.

[21] Appl. No.: 509,828

[22] Filed: Jun. 30, 1983

[51] Int. Cl.[3] ..... C10G 69/10

[52] U.S. Cl. ..... 208/60; 208/70; 585/312; 585/322

[58] Field of Search ..... 208/67, 70, 58, 59, 208/60; 585/322, 312

[56] References Cited

U.S. PATENT DOCUMENTS

| | | | |
|---|---|---|---|
| 3,827,968 | 8/1974 | Givens et al. | 585/322 |
| 4,211,640 | 7/1980 | Garwood et al. | 208/255 |
| 4,251,348 | 2/1981 | O'Rear et al. | 585/322 |

*Primary Examiner*—Delbert E. Gantz
*Assistant Examiner*—Anthony McFarlane
*Attorney, Agent, or Firm*—Alexander J. McKillop; Michael G. Gilman; Dennis P. Santini

[57] ABSTRACT

A process is provided for catalytically dewaxing a middle distillate with a ZSM-5 type catalyst. In this process the olefinic by-product is separated and catalytically converted to additional fuel oil and gasoline of good quality.

10 Claims, 1 Drawing Figure

PROCESS FOR DEWAXING MIDDLE DISTILLATES

BACKGROUND OF THE INVENTION

1. Field of the Invention

This invention is concerned with dewaxing a middle distillate to reduce the pour point thereof. It is particularly concerned with catalytically dewaxing a petroleum distillate utilizing as dewaxing catalyst a crystalline zeolite having a Constraint Index of 1 to 12 as further defined below, and a silica to alumina ratio of at least 12. It is still more particularly concerned with such dewaxing process wherein the olefinic by-product formed in the dewaxing step is treated separately with a catalyst such as ZSM-5 to produce an improved set of products, including a higher yield of fuel oil, all as more fully described herein below.

2. Prior Art

Catalytic dewaxing per se is known and described in U.S. reissue patent, U.S. Pat. No. Re. 28,398 to Chen et al.

The broad concept of contacting an olefinic charge with the special type of zeolite with which this invention is concerned is known in the art and is the subject of various United States patents. Thus, for example, U.S. Pat. No. 3,960,978 teaches conversion of olefins to olefinic gasolines. U.S. Pat. No. 4,021,502 discloses conversion of olefins over ZSM-12. U.S. Pat. No. 3,750,024 discloses contacting olefins with ZSM-5 type zeolites. U.S. Pat. No. 3,778,501 discloses preparation of aromatics by contacting olefins over ZSM-5 type catalysts. U.S. Pat. No. 3,827,968 discloses a two-step aromatization wherein in the first step an olefin is contacted over a ZSM-5 type zeolite. U.S. Pat. No. 3,845,150 discloses contacting a feed comprising saturated and unsaturated compounds over a ZSM-5 type zeolite in order to form aromatics. U.S. Pat. No. 3,843,740 also discloses an aromatization process wherein various feed streams, including gasoline, are contacted with ZSM-5 type zeolites. U.S. Pat. No. 3,756,942 discloses an aromatization process involving contact over ZSM-5 type catalysts of various feeds, including gasoline.

More recent patents in the same general area include U.S. Pat. No. 4,254,295 to Tabak, which describes the use of ZSM-12 in the liquid-phase oligomerization of straight and branched chain olefins which may have from 2 to 12 carbon atoms, but preferably from 2 to 6 carbon atoms; U.S. Pat. No. 4,227,992 to Garwood et al. which describes the separation of ethylene in admixture with light olefins by contacting the mixture with a member of the special class of zeolites used in the present invention. U.S. Pat. No. 4,211,640 to Garwood discloses that the gum stability property of a highly olefinic gasoline is improved by contact with the forementioned type catalyst under reaction conditions carefully selected so as to substantially avoid formation of either aromatic hydrocarbons or products lighter than $C_6$. Some fuel oil is formed in this process.

The prior art dewaxing process wherein the catalyst used is of the ZSM-5 type is believed to operate at least in part by selectively cracking the waxy normal and singly methyl-substituted paraffins to form lower molecular weight of olefins and paraffins. Regardless of mechanism, such dewaxing results in the formation of a by-product hydrocarbon fraction that has a lower average molecular weight than the charge and a substantial content of olefins. A very considerable portion of this by-product fraction is a liquid that boils within the boiling range of gasoline, but this liquid is of limited value as gasoline because of its high mercaptan content and high bromine number. Also, in many cases fuel oil is as valuable as gasoline, or even more valuable.

BRIEF SUMMARY OF THE INVENTION

In the process of the present invention, the by-product hydrocarbon fraction formed in dewaxing a hydrocarbonaceous fuel oil with a ZSM-5 type catalyst is separated from the dewaxed oil and contacted with a ZSM-5 type catalyst under conditions effective to decrease the specific volume of the $C_5$ to 330° F. cut by at least 0.05 cc/g. Such treatment results in conversion of a portion of the by-product to additional fuel oil, and the remaining gasoline fraction is of improved quality.

DETAILED DESCRIPTION OF THE INVENTION

Figure 1:
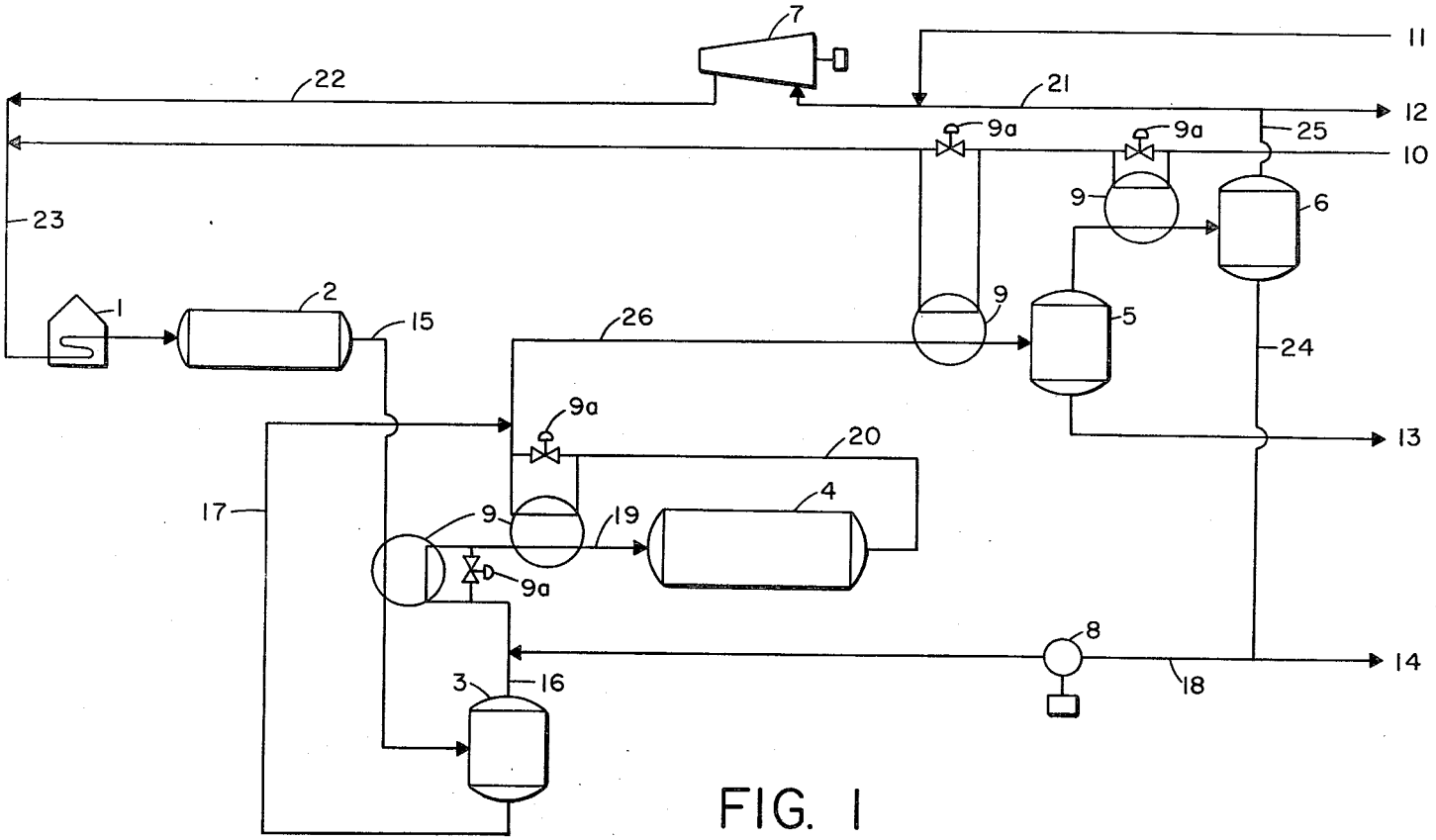
FIG. 1 of the drawing attached hereto is a flowsheet which shows an embodiment of the present invention.

Any hydrocarbonaceous oil having an unacceptably high pour point that is lowered by conventional dewaxing may be used as feed to the improved catalytic dewaxing process of this invention. Petroleum crudes and syncrudes such as shale oils which tend to be very waxy may be used, either as such, or to provide a suitable distillate fraction for dewaxing. As now contemplated, the present invention is particularly well suited to dewaxing a petroleum distillate that boils within the range of about 500° to about 1050° F., i.e. a so-called "vacuum" or "middle distillate". Examples of suitable fractions are a heavy atmospheric gas oil boiling from about 500° to 725° F. and a vacuum gas oil boiling from about 650° to about 1000° F. Although any of the foregoing distillates are suitable as feeds, the benefits of this invention increase with increasing wax content of said feed.

In the first step of the present process, the feed is catalytically dewaxed with a ZSM-5 type catalyst, more fully described hereinbelow, by a process such as that described in U.S. Pat. No. Re. 28,398 to Chen et al., which patent is incorporated herein by reference as if fully set forth. Process modifications such as those described in U.S. Pat. No. 3,956,102 to Chen et al. and in U.S. Pat. No. 4,229,282 to Peters et al. also may be used for the first step. These patents, too, are incorporated herein by reference. Other variants of the catalytic dewaxing process in which a shape-selective zeolite is used to convert the waxy constituents to an olefinic by-product also are contemplated as suitable for the first step of the present invention.

Since the dewaxing step of the present improved process is known in the art, no detailed description need be given here other than to note that a typical middle distillate catalytic dewaxing process that employs a ZSM-5 type catalyst is conducted usually with a fixed bed of catalyst, in the presence of hydrogen gas, at a total pressure of about 300 to 600 psig (pounds per square inch gauge), and at a lined-out temperature of about 550° to about 800° F.

The amount and nature of the by-product fraction produced in the dewaxing step will depend on the nature of the feed, the specific catalyst used, and the dewaxing conditions. However, a suitable by-product fraction will contain at least 25 wt% and up to 50 wt% or more of olefins and more than about 40 wt% of hydrocarbons boiling in the $C_5$ to 415° F. range, i.e. in the boiling range of gasoline, with usually less than about 5 wt% of methane and $C_2$ hydrocarbons. In general, as indicated above, the gasoline fraction is not well-suited for use as such because of either excessive bromine number, high mercaptan content, or both.

In the improved process of the present invention, the by-product fraction is separated from the effluent from the catalytic dewaxer and is contacted with a ZSM-5 type catalyst under conditions effective to convert a portion of the fraction to higher-boiling material, i.e. fuel oil, with simultaneous reduction of the bromine number and mercaptan content of the remaining gasoline. Separation of the by-product fraction from the dewaxed oil may be effected by any known technique, although it is preferred for present purposes to separate by use of a high temperature and high pressure flash separation unit. Also, although only a portion of the by-product fraction, with or without separation of hydrogen, may be treated in a second stage, it is preferred to simply cascade the total fraction from the flash unit, including hydrogen if present, to the subsequent stage of treatment.

The by-product fraction is passed to a catalytic reactor that contains a ZSM-5 type catalyst, more fully described hereinbelow, wherein it is contacted with the catalyst at a temperature, a pressure and a LHSV (liquid hourly space velocity) within the following ranges:

| Ranges | Broad | Preferred |
|---|---|---|
| Temperature, °F. | 400° to 900° | 500° to 800° |
| Pressure, psig | 15 to 2000 | 100 to 800 |
| LHSV | 0.2 to 10 | 0.5 to 2 |

It is to be immediately understood that the above recitation of ranges of pressure, space velocity, and temperature is not intended to mean that all operations within the above set forth limits will result in producing the desired results of the instant invention. On the contrary, what is meant by the above limits concerning temperature, pressure and space velocity is best expressed in a negative way. Operations outside the ranges specifically set forth will not result in the improved process of this invention. It is well known in the art that there is a correlation between temperature, pressure and space velocity with respect to the severity of a given chemical reaction. Quite simply put, the present invention is concerned with converting at least 10 wt% of the olefinic by-product fraction to material boiling above about 350° F., which conversion occurs when the set of operating conditions used is severe enough to induce a decrease of the specific volume of the remaining treated $C_5$ to 330° F. cut by at least 0.05 cc/g, and preferably by at least 0.07 cc/g, when compared with the same cut of untreated by-product, measured at 70° F. Such conditions not only produce a substantial fuel oil fraction but also result in a gasoline that has substantially less than half of the original content of olefins and mercaptans.

As will be illustrated later by example, one may vary the severity of treatment of the by-product fraction within fairly wide limits to control the composition of the gasoline product. Under mild operating conditions within the above described limits, the gasoline will be essentially paraffinic, with a small content, up to 10% , of aromatics and will contain some olefins. Increased severity results in a gasoline that contains somewhat more than 50% aromatics, very little olefins and a very low mercaptan content. This control of quality is achieved with substantially no loss of the by-product fraction by conversion to propane and lighter hydrocarbons. In general, these advantageous results will be achieved by combinations of the foregoing reaction conditons which decrease the specific volume of the $C_5$ to 330° F. cut by at least 0.05 cc/g to not more than about 0.23 cc/g.

The level of severity which produces the advantageous results of this invention also may be specified in terms of the increase in wt% aromatic hydrocarbon content of the $C_5$ to 330° F. cut. In general, an increase of at least 5.5 wt% of aromatics in this cut taken after catalytically treating the by-product fraction as compared with the same cut taken before treatment is adequate. The useful range of increase in wt% aromatics may be from 5.5 wt% to about 65 wt%.

The foregoing means for defining the conditons of treatment are used because it is not possible to define the operating parameters of this invention merely by reciting a range of temperatures, pressures and velocities.

The crystalline zeolites useful as catalysts for converting the by-product fraction are members of a novel class of zeolites that exhibit unusual properties. Although these zeolites have unusually low alumina contents, i.e. high silica to alumina ratios, they are very active even when the silica to alumina ratio exceeds 30. The activity is surprising since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning with oxygen-containing gas such as air.

An important characteristic of the crystal structure of this class of zeolites is that it provides constrained access to and egress from the intracrystalline free space by virtue of having an effective pore size intermediate between the small pore Linde A and the large pore Linde X, i.e. the pore windows of the structure have about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The preferred zeolites useful in this invention have an effective pore size such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of oxygen atoms, then access to molecules of larger cross-section then normal hexane is excluded and the zeolite is not of the desired type. Windows of 10-membered rings are preferred, although in some instances excessive puckering of the rings or pore blockage may render these zeolites ineffective. 12-membered rings usually do not offer sufficient constraint to produce the advantageous conversions, although the puckered 12-ring structure of TMA offretite shows constrained access. Other 12-ring structures may exist which, due to pore blockage or to other cause, may be operative.

Rather than attempt to judge from crystal structure whether or not a zeolite possesses the necessary constrained access to molecules larger than normal paraffins, a simple determination of the "Constraint Index", or C.I., as herein defined may be made by passing continuously a mixture of an equal weight of normal hexane and 3-methylpentane over a small sample, approximately one gram or less, of zeolite at atmospheric pressure according to the following porcedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature is adjusted between 550° F. and 950° F. to give an overall conversion between 10% and 60%. The mixture of hydrocarbons is passed at 1 liquid hourly space velocity (i.e. 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The C.I. is calculated as follows:

$$C.I. = \frac{\log_{10}(\text{fraction of n-hexane remaining})}{\log_{10}(\text{fraction of 3-methylpentane remaining})}$$

The Constraint Index approximates the ratio of the cracking rate constants for the two hydrocarbons. Zeolites suitable for the present invention are those having a Constraint Index of 1 to 12. C.I. values for some typical zeolites are:

| CAS | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| TMA Offretite | 3.7 |
| Beta | 0.6 |
| H—Zeolon (mordenite) | 0.4 |
| REY | 0.4 |

-continued

| CAS | C.I. |
|---|---|
| Amorphous Silica-Alumina | 0.6 |
| Erionite | 38 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby have different Constraint Indexes. Constraint Index seems to vary somewhat with severity of operation (conversion) and the presence or absence of binders. Therefore, it will be appreciated that it may be possible to so select test conditions to establish more than one value in the range of 1 to 12 for the Constraint Index of a particular zeolite. Such a zeolite exhibits the constrained access as herein defined and is to be regarded as having a Constraint Index of 1 to 12. Also contemplated herein as having a Constraint Index of 1 to 12 and therefore within the scope of the novel class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value of 1 to 12. Thus, it should be understood that the Constraint Index value as used herein is an inclusive rather than an exclusive value. That is, a zeolite when tested by any combination of conditions within the testing definition set forth hereinabove and found to have a Constraint Index of 1 to 12 is intended to be included in the instant catalyst definition regardless that the same identical zeolite tested under other defined conditions may give a Constraint Index value outside of 1 to 12.

The class of zeolites defined herein is exemplified by ZSM-5, ZSM-11, ZSM-12, ZSM-21, ZSM-23, ZSM-35, ZSM-38, ZSM 48, and other similar materials. U.S. Pat. No. 3,702,866 describing and claiming ZSM-5 is incorporated herein by reference.

ZSM-11 is more particularly described in U.S. Pat. No. 3,709,979, the entire content of which is incorporated herein by reference.

ZSM-12 is more particularly described in U.S. Pat. No. 3,832,449, the entire content of which is incorporated herein by reference.

ZSM-21 is more particularly described in U.S. Pat. No. 4,046,859, the entire content of which is incorporated herein by reference.

ZSM-23 is more particularly described in U.S. Pat. No. 4,076,842, the entire content of which is incorporated herein by reference.

ZSM-35 is more particularly described in U.S. Pat. No. 4,016,245, the entire content of which is incorporated herein by reference.

ZSM-38 is more particularly described in U.S. Pat. No. 4,046,859, the entire content of which is incorporated herein by reference.

The specific zeolites described, when prepared in the presence of organic cations, are substantially catalytically inactive, possibly because the intracrystalline free space is occupied by organic cations from the forming solution. They may be activated by heating in an inert atmosphere at 1000° F. for one hour, for example, followed by base exchange with ammonium salts followed by calcination at 1000° F. in air. The presence of organic cations in the forming solution may not be absolutely essential to the formation of this type zeolite; however, the presence of these cations does appear to favor the formation of this special class. More generally, it is desirable to activate this type catalyst by base exchange with ammonium salts followed by calcination in air at about 1000° F. for from about 15 minutes to about 24 hours.

Natural zeolites may sometimes be converted to this type zeolite catalyst by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline zeolites are ZSM-5, ZSM-11, ZSM-12, ZSM-21, ZSM-23, ZSM-35, ZSM-38 and ZSM-48, with ZSM-5 and ZSM-11 particularly preferred. In some instances, it is advantageous to steam the fresh zeolite to reduce its activity and thereby improve its selectivity prior to use. Such improvement has been noted with steamed ZSM-5.

In a preferred aspect of this invention, the zeolites selected are those having a crystal framework density, in the dry hydrogen form, of not less than about 1.6 grams per cubic centimeter. It has been found that zeolites which satisfy all three of these criteria are most desired. Therefore, the preferred zeolites of this invention are those having a Constraint Index as defined above of about 1 to 12 and a dried crystal density of not less than about 1.6 grams per cubic centimeter. The dry density for known structures may be calculated from the number of silicon plus aluminum atoms per 1000 cubic Angstroms, as given, e.g., on Page 19 of the article on Zeolite Structure by W. M. Meier. This paper, the entire contents of which are incorporated herein by reference, is included in "Proceedings of the Conference of Molecular Sieves, London, April 1967," published by the Society of Chemical Industry, London, 1968. When the crystal structure is unknown, the crystal framework density may be determined by classical pyknometer techniques. For example, it may be determined by immersing the dry hydrogen form of the zeolite in an organic solvent not sorbed by the crystal. Or, the crystal density may be determined by mercury porosimetry, since mercury will fill the interstices between crystal but will not penetrate the intracrystalline free space. It is possible that the unusual sustained activity and stability of this class of zeolites is associated with its high crystal anionic framework density of not less that about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, 11 | .29 | 1.79 |
| ZSM-12 | — | 1.8 |
| ZSM-23 | — | 2.0 |

-continued

| Zeolite | Void Volume | Framework Density |
|---|---|---|
| Dachiardite | .32 | 1.72 |
| L | .32 | 1.61 |
| Clinoptilolite | .34 | 1.71 |
| Laumontite | .34 | 1.77 |
| ZSM-4, Omega | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable metal cations of Groups I through VIII of the Periodic Table, including, by way of example, nickel, copper, zinc, palladium, calcium or rare earth metals.

In the process of this invention, it may be desirable to incorporate the above-described crystalline aluminosilicate zeolite in another material resistant to the temperature and other conditions employed in the process. Such matrix materials include synthetic or naturally occuring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the subbentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix on an anhydrous basis may vary widely with the zeolite content ranging from between about 5 to about 99 percent by weight and more usually in the range of about 10 to about 80 percent by weight of the dry composite.

The present invention will now be described with reference to FIG. 1 of the drawing. Makeup hydrogen passed via line (11) together with recycle gas passed via line (21) are sent to recycle gas compressor (7) where they are brought up to reaction pressure. The pressurized gas is passed via line (22) and, together with distillate oil feed introduced via line (10), is passed via line (23) to distillate feed furnace (1) where it is heated to about dewaxing temperature. The heated feed and gas are then passed to the dewaxing reactor (2) that is charged with a ZSM-5 type dewaxing catalyst. The total effluent, which includes hydrogen, an olefinic by-product fraction, and dewaxed fuel oil, is passed via line (15) to a high temperature, high pressure flash unit (3). The overhead from this flash unit, the by-product fraction, is passed via line (16) to one or more heat exchangers to adjust its temperature and then via (19) to by-product reactor (4), where a portion of the fraction is converted to additional low pour point fuel oil and the remainder to upgraded gasoline. Because the conversion of the by-product fraction is exothermic, a temperature rise of up to about 100° F. or greater may occur, depending on the olefin content of the by-product and the reaction conditions chosen. To moderate this exotherm, and to better control temperature, a portion of the upgraded gasoline product may be recycled through reactor (4) via lines (24), (18) and recycle liquid pump (8). In any case, the total effluent, including excess hydrogen, is passed from reactor (4) through line (20), and then to line (26) together with the bottoms from flash separator (3) passed via line (17), and the mixture is introduced into the high temperature, high pressure flash separator (5). The bottoms from separator (5), which is the total dewaxed fuel oil produced by the process, is removed via line (13) and may be passed to a unit for flash point stabilization (not shown). The total overhead from reactor (5) is passed to the low temperature, high pressure flash unit (6). The flash liquid from (6), which is essentially the upgraded gasoline produced by the process, is passed via line (24) and line (14) and then it may be passed to a unit for vapor pressure stabilization (not shown). A portion of this liquid product may be diverted from line (24) to line (18) and recycled, as described above, to assist in temperature control of reactor (4). The overhead from separator (6) is removed via line (25), and a portion of it is purged via line (12). The remainder is recycled to dewaxing unit (2) via line (21). One or more heat exchangers (9) are used together with one or more associated bypass valves (9*a*) to conserve heat and facilitate control of temperatures in the reactors and flash units.

Although a preferred process configuration is represented by the foregoing description, it will be understood by those skilled in the art that modifications of the process may be made without departing from the spirit of the present invention as claimed.

The following examples will serve to further illustrate this invention. These examples are to be considered illustrative only, and are not to be construed as limiting the scope of the invention. All parts and percentages are by weight unless explicitely stated to be otherwise.

EXAMPLES

Example 1

This example illustrates the treatment of the by-product fraction by the method of this invention with a mild combination of reaction conditions.

A Kuwait gas oil boiling from 600° F. to 750° F. was dewaxed in the presence of hydrogen by a prior art process in which a ZSM-5 dewaxing catalyst was used. The by-product fraction boiling up to 330° F. was separated from the dewaxer effluent, and part of it was contacted with a ZSM-5 catalyst in the presence of hydrogen at 530° F., a total pressure of 600 psig, and at a LHSV=0.35. Several material balances were made in the course of the test, and the accumulated product was analyzed with the results shown in Table 1. As shown there, about 38% of the by-product was converted to hydrocarbons boiling above 330° F., i.e. to material suitable for incorporation with the dewaxed fuel oil.

Example 2

The same by-product fraction as used in Example 1 was treated in the presence of hydrogen with the same ZSM-5 catalyst but under a more severe set of conditons. In this example the temperature was 730° F., the total pressure 300 psig, with the LHSV=1.0. As with Example 1, several material balances were made and the accumulated product was analyzed with the results shown in Table 1. Noteworthy is the high content of aromatics in the $C_5$ to 330° F. gasoline fraction, and its consequent high octane number of 105.0. In this example 35.0% of the by-product was converted to higher boiling fuel oil.

Example 3

In this example a Kuwait Heavy Gas Oil having the following specifications

| | |
|---|---|
| Gravity, °API | 30.4 |
| Hydrogen, wt % | 13.05 |
| Sulfur, wt % | 1.75 |
| Nitrogen, wt % | .019 |
| Pour Point, °F. | 60.0 |
| Distillation, °F. | |
| 5% | 593 |
| 20% | 657 |
| 50% | 707 |
| 70% | 730 |
| 95% | 776 |

was dewaxed in the conventional way at 730° F., 460 psig total pressure, and at a LHSV=2.0 with a Ni-ZSM-5 extrudate catalyst having the following specifications:

| | |
|---|---|
| Crystallinity, % | 55 |
| Nickel, wt % | 1.1 |
| Sodium, wt % | 0.02 |
| Alpha Activity | 101 |
| Density, gm/cc | |
| Packed | .58 |
| Particle | .90 |
| Real | 2.49 |
| Surface Area, $m^2$/gm | 350 |
| Pore Volume, cc/gm | .714 |
| Ave Pore Dia, A | 82 |

Example 4

The total effluent from the catalytic dewaxing reactor in Example 3 is passed to a high temperature, high pressure flash unit operated at 415 psig and 600° F. The composition of the dewaxer effluent, the flash vapor, and the flash liquid are shown in Table 2.

Example 5

The flash vapor by-product of Example 4 is treated with the ZSM-5 catalyst described in Example 3, at LHSV=1.0, 300 psig total pressure and at 730° F. The treated by-product is combined with the flash liquid. The compositions of the total dewaxer effluent before separation of by-product and after the by-product is converted and mixed with the flash liquid are compared in Table 3. It is seen therefrom that the process of this invention results in a substantial increase in $C_5$+ products and especially of fuel oil, and that the amount of gasoline is reduced but of substantially superior quality.

TABLE 1

| UPGRADING OF BY-PRODUCT GASOLINE | Raw By-Product | Ex. 1. | Ex. 2 |
|---|---|---|---|
| °F. | | 530 | 730 |
| PSIG | | 600 | 300 |
| LHSV | | 0.35 | 1.0 |
| $C_4$- | 15.5 | 15.0 | 13.2 |
| $C_5$-330° F. | 84.5 | 47.3 | 51.8 |
| 330° F.+ | | 37.7 | 35.0 |
| $C_5$-330° F. | | | |
| Paraffins | 30.3 | 69.0 | 38.3 |
| Olefins | 65.3 | 19.8 | 2.6 |
| Naphthenes | 1.6 | 2.7 | 2.6 |
| Aromatics | 2.8 | 8.5 | 56.5 |
| API Gravity | 77.5 | 62.2 | 54.8 |
| R + O | 92.0 | 81.3 | 105.0 |
| PPM Mercaptan | 199 | 9.0 | 5.0 |
| Bromine No. | 130 | 47.1 | 6.5 |
| 330° F.+ | | | |
| API Gravity | | 49.6 | 45.2 |
| Flash Pt (°F.) | | — | 145 |
| Cloud Pt (°C.) | | −65* | −65* |
| $H_2$, wt. % | | 11.9 | 11.8 |
| M.W. | | 203 | 178 |
| Smoke Pt | | 10.3 | 9.1 |
| Distillation, °F. | | | |
| 5% | | 331 | 325 |
| 10% | | 341 | 328 |
| 20% | | 365 | 339 |
| 50% | | 418 | 379 |
| 80% | | 558 | 494 |
| 90% | | 669 | 556 |
| 95% | | 699 | 663 |

*Less than

TABLE 2

| FLASH SEPARATION OF DISTILLATE DEWAXING REACTOR PRODUCT | COMPOSITIONS | | |
|---|---|---|---|
| | Dewaxer Effluent | Flash Vapor | Flash Liquid |
| Methane, wt % | .02 | .02 | — |
| Ethylene | .04 | .04 | — |
| Ethane | .07 | .07 | — |
| Propene | .84 | .81 | .03 |
| Propane | 1.15 | 1.09 | .06 |
| Butenes | 2.90 | 2.69 | .21 |
| Butanes | 2.27 | 2.10 | .17 |
| $C_5$-330° F. | 12.50 | 10.31 | 2.19 |
| 330-550° F. | 4.45 | 2.35 | 2.10 |
| 550° F.+ | 76.00 | 5.64 | 69.02 |
| | 100.00 | 25.12 | 74.88 |
| $H^2$ SCF/bbl Chg | 1500 | 1480 | 20.0 |

TABLE 3

| PROCESS YIELDS | | |
|---|---|---|
| Product Yields | Total Dewaxer Effluent (Prior Art) | Total Product After By-Product Treatment |
| $C_1$, wt % | .02 | .04 |
| $C_2$= | .04 | .05 |
| $C_2$ | .07 | .13 |
| $C_3$= | .84 | .22 |
| $C_3$ | 1.15 | 1.79 |
| $C_4$= | 2.90 | .21 |
| i + n$C_4$ | 2.27 | 3.02 |

TABLE 3-continued

| PROCESS YIELDS | | |
|---|---|---|
| Product Yields | Total Dewaxer Effluent (Prior Art) | Total Product After By-Product Treatment |
| $C_5$+ Gasoline | 12.50 | 8.41 |
| 330° F.+ Distillate | 80.45 | 86.13 |
| | 100.00 | 100.00 |
| Product Properties | | |
| $C_5$-330° F. Gasoline | | |
| Gravity, °API | 77.5 | 55 |
| R + O | 92.0 | 105 |
| PPM Mercaptans | 199 | 5 |
| Bromine No. | 130 | 6.5 |
| 330° F.+ Distillate | | |
| Gravity, °API | 25.7 | — |
| Pour Point, °F. | −10 | −15 |
| Sulfur, wt % | 2.63 | 2.36 |
| Distillation | | |
| 50%, °F. | 724 | 710 |
| 95%, °F. | 841 | 830 |

What is claimed is:

1. In a process for catalytically dewaxing a hydrocarbonaceous fuel oil feed boiling within the range of about 500° F. to about 1050° F., which process comprises contacting said feed under dewaxing conditions with a crystalline aluminosilicate zeolite having a Constraint Index of 1 to 12 and a silica to alumina ratio of at least 12 thereby forming a dewaxed fuel oil having a reduced pour point and a by-product fraction that contains olefins, said fraction boiling up to about 415° F. and containing more than about 40 wt% of hydrocarbons boiling in the $C_5$ to 415° F. range, the improvement, whereby the yield of dewaxed oil is increased, which comprises:

separating said by-product fraction including contained olefins from said dewaxed fuel oil; and converting said separated by-product fraction by contact with a crystalline zeolite catalyst having a Constraint Index of 1 to 12 and a silica to alumina ratio of at least about 12 under a combination of reaction conditions that include a temperature of about 400° F. to about 900° F., a pressure of 15 to 2000 psig, and a LHSV of about 0.2 to 10, said combination of conditions being effective to decrease the specific volume of the $C_5$+ to 330° F. cut of said by-product fraction by at least 0.05 cc/g.

2. The process described in claim 1 including the step of recovering fuel oil and gasoline from said converted by-product fraction.

3. The process described in claim 1 wherein said feed is a petroleum distillate.

4. The process described in claim 2 wherein said feed is a petroleum distillate.

5. The process described in claim 1 or 2 or 3 or 4 wherein said converting of said by-product fraction is conducted in the presence of hydrogen gas with a crystalline zeolite selected from the group consisting of ZSM-5, ZSM-11, ZSM-12, ZSM-21, ZSM-23, ZSM-35, ZSM-38 and ZSM-48.

6. The process described in claim 1 or 2 or 3 or 4 wherein said converting of said by-product fraction is conducted in the presence of hydrogen gas with ZSM-5 catalyst.

7. A process for catalytically dewaxing a petroleum distillate feed boiling within the range of about 500° F. to about 1050° F., which comprises:

contacting said feed and hydrogen gas under dewaxing conditions in a first reactor with a first crystalline aluminosilicate catalyst having a Constraint Index of 1 to 12 and a silica to alumina ratio of at least 12 thereby forming a dewaxed fuel oil and a by-product fraction that contains olefins, said fraction boiling up to about 415° F. and containing more than about 40 wt% of hydrocarbons boiling in the $C_5$ to 415° F. range;

separating said by-product fraction and hydrogen from said dewaxed fuel oil;

cascading said separated by-product fraction and hydrogen to a second reactor wherein it is converted with a second crystalline aluminosilicate zeolite catalyst having a Constraint Index of 1 to 12 and a silica to alumina ratio of at least 12, said conversion being conducted under a combination of reaction conditions effective to increase the aromatic hydrocarbon content of said by-product fraction by from at least 5.5 wt% to about 65 wt%; and recovering fuel oil and gasoline from said converted by-product fraction.

8. The process described in claim 7 wherein said olefinic by-product fraction contains at least 25 wt% olefins and said separation is effected by flash distillation.

9. The process described in claim 7 or 8 wherein said second crystalline aluminosilicate zeolite catalyst is selected from the group consisting of ZSM-5, ZSM-11, ZSM-12, ZSM-21, ZSM-23, ZSM-35, ZSM-38 and ZSM-48.

10. The process described in claim 7 or 8 wherein said first and said second zeolite catalyst are ZSM-5.

* * * * *

UNITED STATES PATENT AND TRADEMARK OFFICE

CERTIFICATE OF CORRECTION

PATENT NO. : 4,483,760
DATED : November 20, 1984
INVENTOR(S) : Samuel A. Tabak and Robert E. Holland It is certified that error appears in the above—identified patent and that said Letters Patent is hereby corrected as shown below:

Column 1, Line 30 - "3,750,024" should read --3,760,024--

Signed and Sealed this

*Fourteenth* Day of *May 1985*

[SEAL]

*Attest:*

DONALD J. QUIGG

*Attesting Officer* *Acting Commissioner of Patents and Trademarks*